US007731027B2

(12) United States Patent
Kruit

(10) Patent No.: US 7,731,027 B2
(45) Date of Patent: Jun. 8, 2010

(54) PACKAGE AND BLANK AND APPARATUS FOR FORMING SUCH PACKAGE

(75) Inventor: Jan Peter Kruit, Gouda (NL)

(73) Assignee: Heineken Technical Services B.V., Amsterdam (NL)

( * ) Notice: Subject to any disclaimer, the term of this patent is extended or adjusted under 35 U.S.C. 154(b) by 551 days.

(21) Appl. No.: 10/551,744

(22) PCT Filed: Apr. 1, 2004

(86) PCT No.: PCT/NL2004/000218

§ 371 (c)(1),
(2), (4) Date: Jun. 5, 2006

(87) PCT Pub. No.: WO2004/092026

PCT Pub. Date: Oct. 28, 2004

(65) Prior Publication Data

US 2006/0231426 A1 Oct. 19, 2006

(30) Foreign Application Priority Data

Apr. 1, 2003 (NL) ..... 1023073

(51) Int. Cl.
*B65D 75/00* (2006.01)

(52) U.S. Cl. ..... 206/427

(58) Field of Classification Search ..... 206/427, 206/434, 435, 193, 170, 175
See application file for complete search history.

(56) References Cited

U.S. PATENT DOCUMENTS

| | | | | |
|---|---|---|---|---|
| 2,659,524 | A | 11/1953 | Mcelwee | |
| 4,216,861 | A | 8/1980 | Oliff | |
| 5,360,113 | A | 11/1994 | Harris | |
| 5,503,324 | A | 4/1996 | Bacchetti et al. | |
| 5,613,933 | A | 3/1997 | Pierce, Jr. et al. | |
| 5,669,500 | A * | 9/1997 | Sutherland | 206/427 |
| 5,704,470 | A | 1/1998 | Sutherland | |
| 6,227,367 | B1 * | 5/2001 | Harrelson et al. | 206/427 |
| 2002/0134698 | A1 | 9/2002 | Rhodes et al. | |

FOREIGN PATENT DOCUMENTS

| | | |
|---|---|---|
| EP | 0630826 | 12/1994 |
| WO | WO 95/12527 | 5/1995 |

* cited by examiner

*Primary Examiner*—Jacob K Ackun, Jr.
(74) *Attorney, Agent, or Firm*—Pearne & Gordon LLP

(57) ABSTRACT

A package for containers such as bottles or cans, in particular beverage containers, folded from a blank, provided with: a substantially closed bottom panel (2); two side panels (4), upstanding from the bottom panel, on opposite sides thereof; two upper flaps (6) folded from the side panels over containers arranged on the bottom panel; end wall flaps (10) extending on both sides of each side panel while confining the containers; and top flaps (12) extending from the upper edges of the end wall flaps facing away from the bottom panel, below or between the upper flaps (6); wherein at least said two flaps (12) and/or the upper flaps (6) are attached to each other.

21 Claims, 8 Drawing Sheets

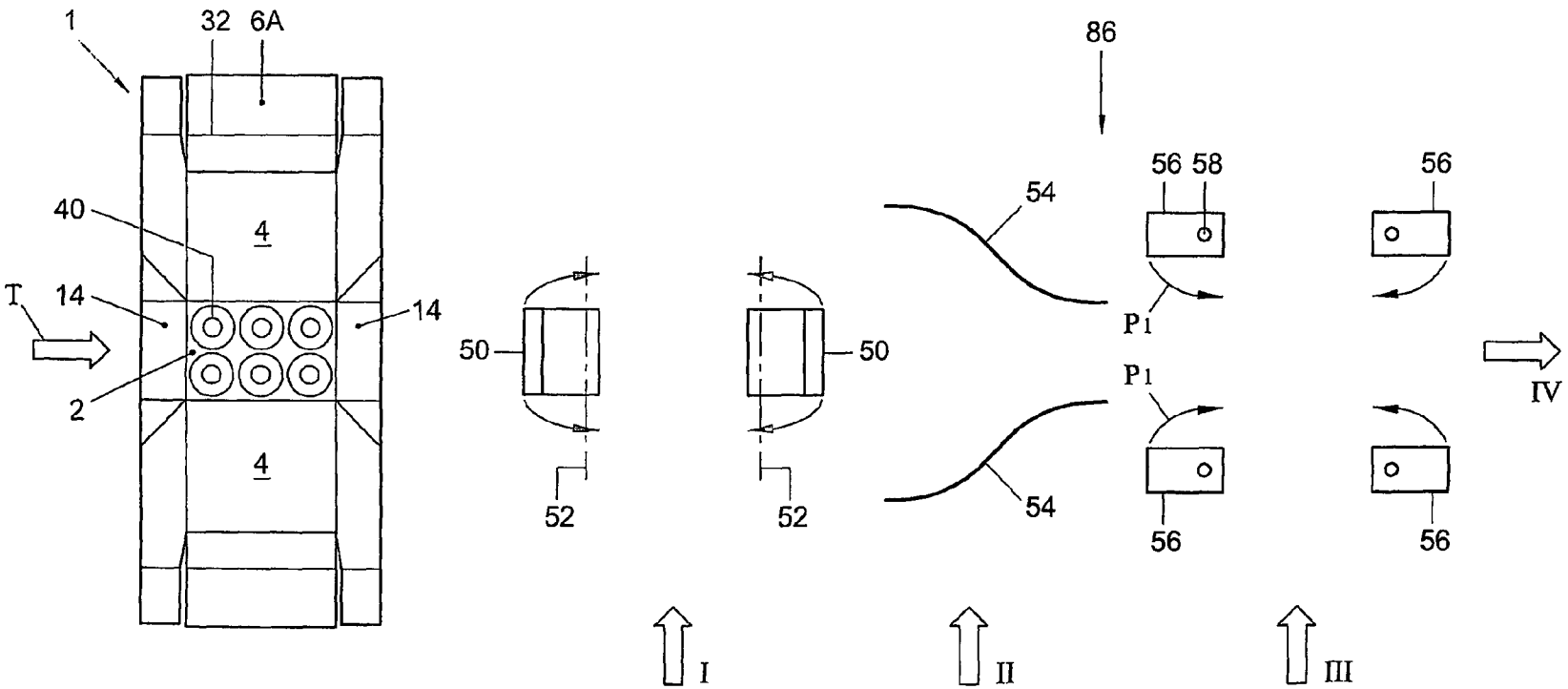
Fig. 10 (1/2)

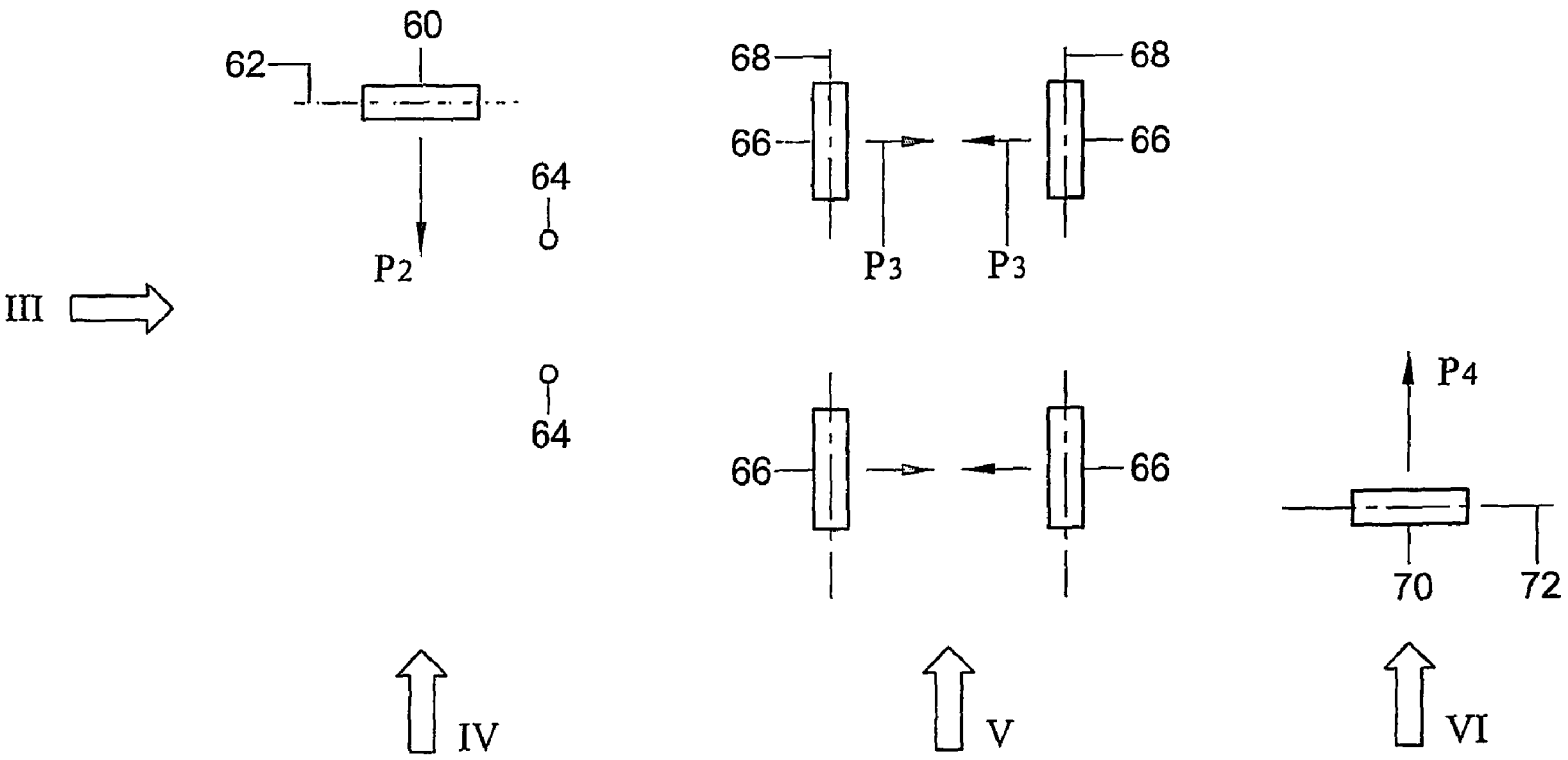
Fig. 10 (2/2)

PACKAGE AND BLANK AND APPARATUS FOR FORMING SUCH PACKAGE

The invention relates to a package for containers such as bottles or cans. In particular, the invention relates to such a package, folded from a blank.

It is known to package containers such as cans and bottles in packages, in particular cardboard packages, folded from blanks. With these known packages, for instance, six drinking bottles in two rows of three are packaged in a cardboard blank which is folded around the bottles. To that end, the blank comprises an upper panel with recesses, in each of which the cap of a bottle is partly received, so that sliding is prevented. From the upper panel, two side panels extend which are folded on both sides against the free sides of the two rows of bottles. On the side remote from the upper panel, each side panel is provided with a bottom flap which can be folded under the rows of bottles and can be hooked into each other with the aid of suitable openings in one of the bottom flaps and matching hooking means in the other bottom flap. In order to have the bottom flaps hook into each other they slightly overlap and rows of holes are provided in which pulling means of a folding apparatus can engage in order to pull the bottom flaps into the correct position.

This known package has as a drawback that the bearing capacity of, in particular, the bottom is limited, so that relatively thick cardboard is to be used. This is the result of, in particular, the hooking means used and the required openings in the bottom flaps. Further, the two ends of the package are open so that bottles received in the package are exposed to light, in particular daylight, which can be disadvantageous to the content of the bottles. In particular products based on natural ingredients such as beer are susceptible thereto. A further drawback of these packages is that the apparatus required thereto is complicated as to set-up and is package-specific. The fact is that the bottom panels are to be folded under the bottles. To that end, the bottles are to be lifted together with the blank. Further, the tools required for hooking the bottom panels into each other are complicated and the arrangement thereof is to be accurately adjusted to the package to be processed. These set-up operations, which take place, for instance, when a switch is made from a six-pack to a four-pack package and/or an altered diameter of the containers, is time-consuming, complex and, hence, expensive. Moreover, as a rule, the bottles are to be introduced by their necks into the suitable recesses.

Further, it is known to use packages folded from cardboard blanks which are wholly or partly closed. Use is then made of end wall flaps which, at the ends (approximately at right angles to the side panels) can be folded against the bottles and are glued, for confining the bottles further. These packages also have as a drawback that relatively much and thick cardboard is used while, moreover, relatively much glue is required. The end wall flaps are only connected to the side panels.

Further, these known packages have as a drawback that during filling and closing of the packages, they are to be rotated through approximately 90°. As a result, the processing rate of these known apparatuses is relatively low, which is expensive. As the rotating can only start after the bottom panel has been closed, the known apparatus is long, resulting in a large foot print and, hence, occupation of space. For changing the apparatus for a different package many operations are to be carried out, which is time-consuming and expensive.

Further, from U.S. Pat. No. 4,216,861, a package is known wherein a blank is folded to form a tube and is glued and, in that condition, is stored and transported. In a packaging machine, the pre-glued, tubular packages are set up whereupon the containers are slid into the tube. Then, with the aid of folding flaps, the front and rear side of the package are closed. Such a package has as a drawback that it is formed in two steps, which is expensive and logistically complicated, that the pre-glued tubular packages take up relatively much space and that, moreover, an additional apparatus is to be provided for both pre-gluing and folding-in the packages and for setting up the packages before they can be filled. This is cumbersome. Furthermore, these packages too are manufactured from relatively heavy and thick cardboard. It is known per se to connect the apparatus with which the tube is formed to the packaging machine, so that logistic problems are solved. However, the tubular apparatus then extends at right angles to the packaging machine, which, in turn, leads to great foot print and associated large and expensive occupation of space.

The object of the invention is a package for containers such as bottles or containers, in particular containers for beverages, folded from a blank. More in particular, the invention contemplates such a package which can be manufactured from relatively light and little cardboard. A further object of the present invention is to provide such a package which can be formed in a simple manner and, furthermore, preferably, offers the possibility to confine the containers substantially screened-off from light. More in particular, the invention contemplates providing such a package with a relatively large bearing capacity.

At least a number of these and further objects are achieved with a package according to the invention, characterized by the features of claim 1.

With a package according to the invention, the bottom panel, on which the containers are arranged, can be designed to be substantially closed. As a result, a relatively great bearing capacity is obtained and, furthermore, the containers can be arranged on the panel in a simple manner whereupon the side panels and upper flaps can be folded over them without the containers having to be lifted. The side panels can at least partly abut against the containers in a simple manner and the upper flaps can rest on each other and/or rest on the containers and simply be fastened, for instance by glue, clamping means, by form-closing or such connecting means. The containers are confined in a simple manner against displacement by the end wall flaps and, furthermore, are screened-off from light, if the end wall flaps extend at least substantially over the full height of the containers.

By folding the top flaps from the end wall flaps over the containers and/or over one of the upper flaps, the advantage is achieved that the top flaps can be designed to be relatively long without the amount of material required for the blank (the surface from which the blank can be punched or cut) having to be undesirably large. Furthermore, the package can be closed relatively easily with the top flaps. Furthermore, this package offers the advantage that it can be set up rapidly and efficiently, while no changes need to be made in the feed-through direction. During filling and setting up of the package, the blank needs not be rotated or lifted along with the containers. Further, with this, the advantage is achieved that the upper side of the package is, at least partly, of double design, so that it can simply be lifted, for instance by providing finger openings in the upper flaps.

A package according to the invention, at least as blank, comprises few openings, so that manufacture and printing can be especially simple, rapid and inexpensive, for instance by rotogravure.

It will be clear that due to the chosen construction, relatively thin material can be used. For instance, cardboard can be used for the blank having a weight of, for instance, 180-280 g/m$^2$ instead of 350-380 g/m$^2$, for a package of six bottles or cans with a content of 25-35 cl of beverage. With it, important economical advantages are achieved.

Preferably, a package according to the invention further comprises an edge flap on each side where the end wall flaps are located, which edge flaps are preferably connected to the bottom panel via fold lines. Furthermore, the edge flaps are preferably also connected to the end wall flaps, via folding flaps, such that the entire package can be folded from one blank. In set-up condition, the edge flaps form upstanding edges against sliding of the containers, while with this, any barcodes on the containers can be screened-off from scanning devices. Coupling to the end wall flaps offers the advantage that setting up is possible in a simple manner while a greater bearing capacity is obtained.

It is preferred that the folding flaps are confined between the containers and the end wall flaps. This renders setting up simpler, with a relatively simple apparatus, while, moreover, a greater firmness is obtained. However, the folding flaps can also be received between the containers and the side panels, which is advantageous in particular if the end wall flaps are relatively low and/or narrow or have even been omitted.

In a further particularly advantageous embodiment, a package according to the invention is further characterized by the features of claim 5.

With such an embodiment, with particularly little glue a connection can be obtained between the two upper flaps and/or the top flaps, while applying the glue as well as closing the package are possible in a simple manner. Designing the glue traces as drops of glue then offers the advantage that even less glue is required.

In an alternative embodiment, a package according to the invention is characterized by the features of claim 7.

With such a manner of closing, particularly little to no glue can suffice. Moreover, thus, handling the filled package becomes possible in an even simpler manner.

The invention further relates to a blank, characterized by the features of claim 8.

With such a blank, in a simple and relatively inexpensive manner, a package for containers such as beverage cans or bottles can be formed, on relatively simple apparatuses. When the end wall flaps have a suitable height the package can be designed to be substantially light-proof, while relatively little and light cardboard or such sheet-shaped material can be used.

With a blank according to the invention, in particular, a package according to the invention can be formed.

Further, the invention relates to the use of the blank according to the invention for forming a package, characterized by the features of claim 15 or 16.

Furthermore, the invention relates to an apparatus for forming a package for containers, characterized, according to the invention, by the features of claim 17 or 18.

Such an apparatus is particularly simple in setup and use and, furthermore, suitable for different sizes and types of packages, both according to the invention and for a number of packages according to the state of the art. The apparatus can be altered in a simple manner, for instance for packaging a different number of containers in a package or for a different manner of closing. Furthermore, such an apparatus can form large numbers of packages particularly rapidly, notably also because the feed-through direction is the same each time; the package (at least the blank therefor) needs not be rotated or lifted during feed-through, which results in the apparatus being less complex than the known apparatuses. Furthermore, the foot print of the apparatus according to the invention can be considerably smaller than with the known apparatuses; it is possible to save over 25% of the surface. Further, the processing capacity is large such that it apparatus according to the invention forms no bottleneck in the production lines, at least less than it does nowadays. For instance, four-packs as well as for, for instance, 18-packs can be processed with sufficient capacity, for instance over 60,000 containers per hour.

The invention further relates to a method for forming a package for containers, characterized by the features of claim 21.

With such a method, particularly rapidly and simply, from relatively little material, packages can be formed with sufficient bearing capacity.

Further advantageous embodiments of a package, blank, use, apparatus and method for forming such a package are given in the subclaims.

In clarification, embodiments of a package, blank, use, apparatus and method for forming such a package will be further described with reference to the drawing. In the drawing.

Figure 8:
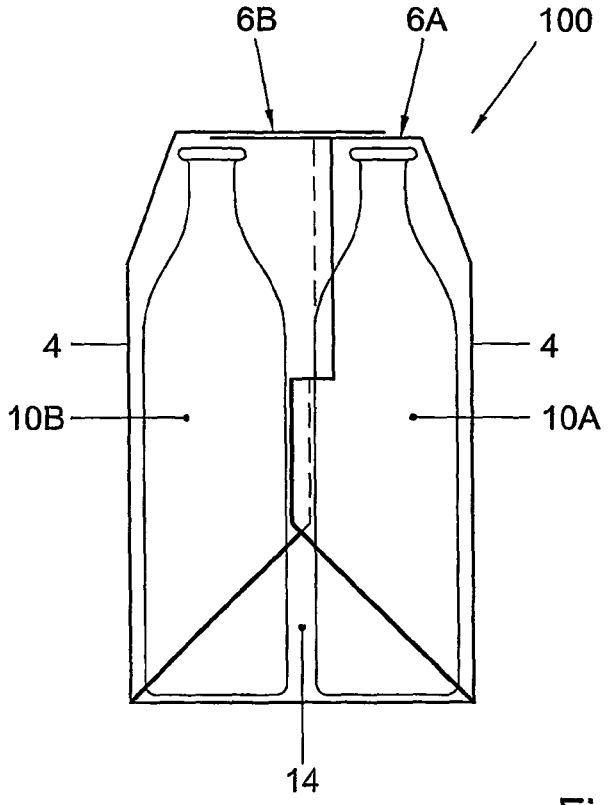
Figure 9:
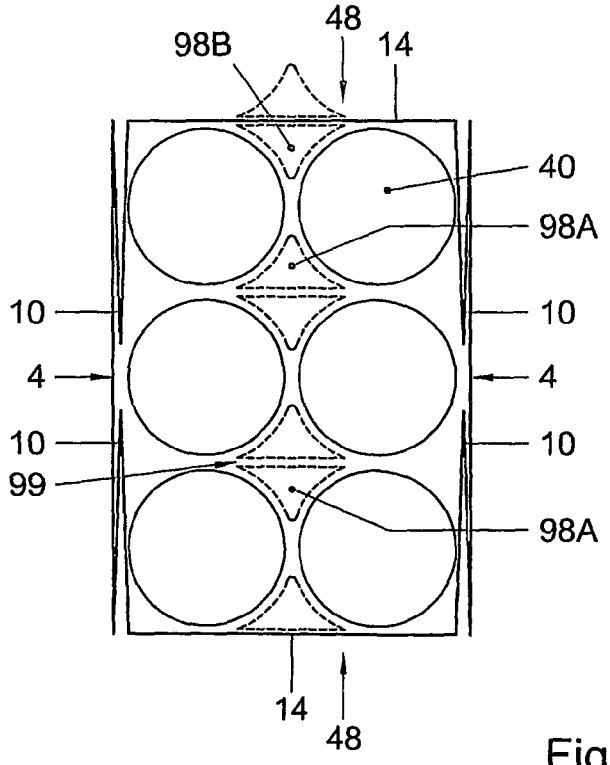
Figure 11:
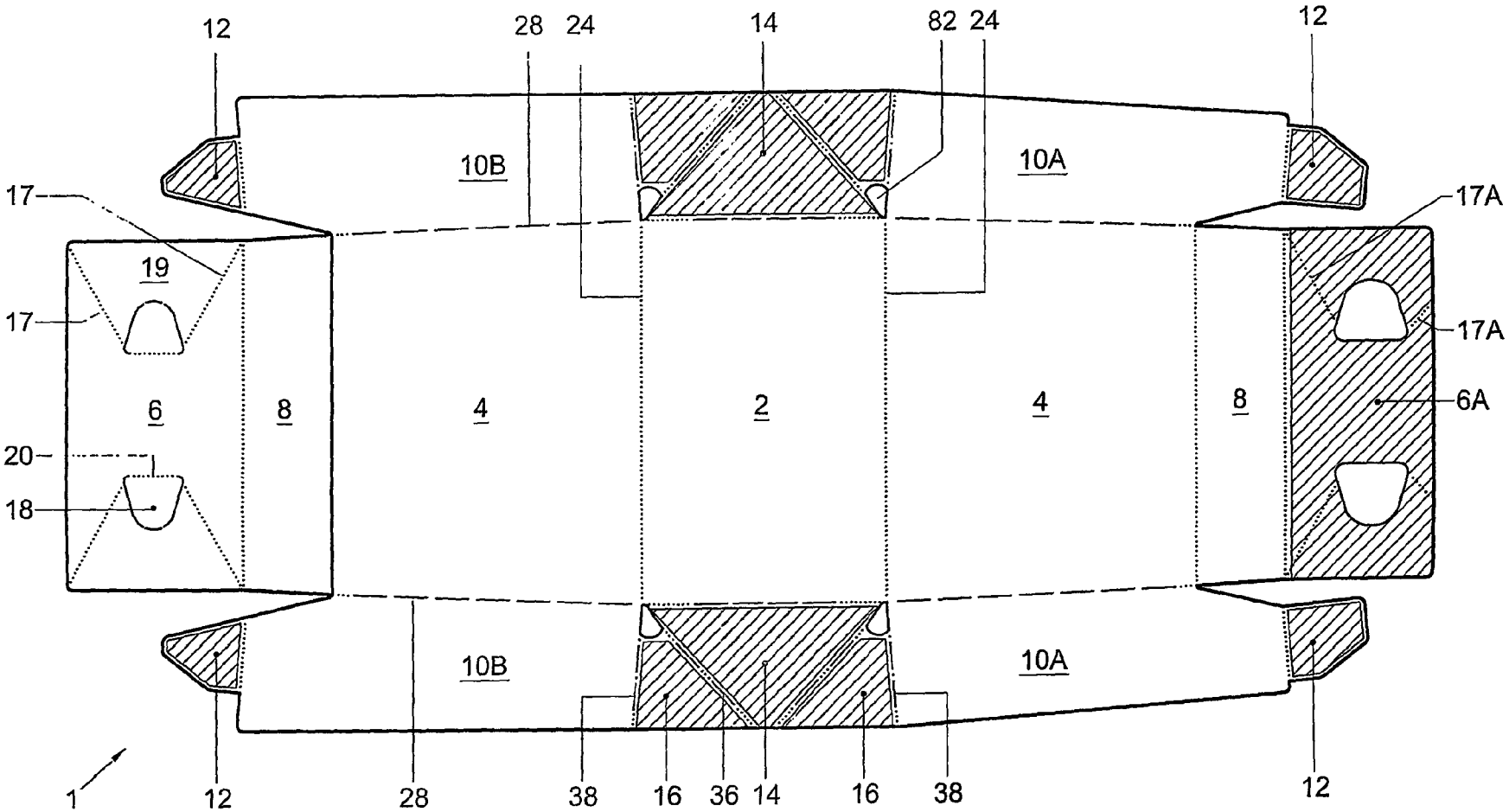
Figure 12:
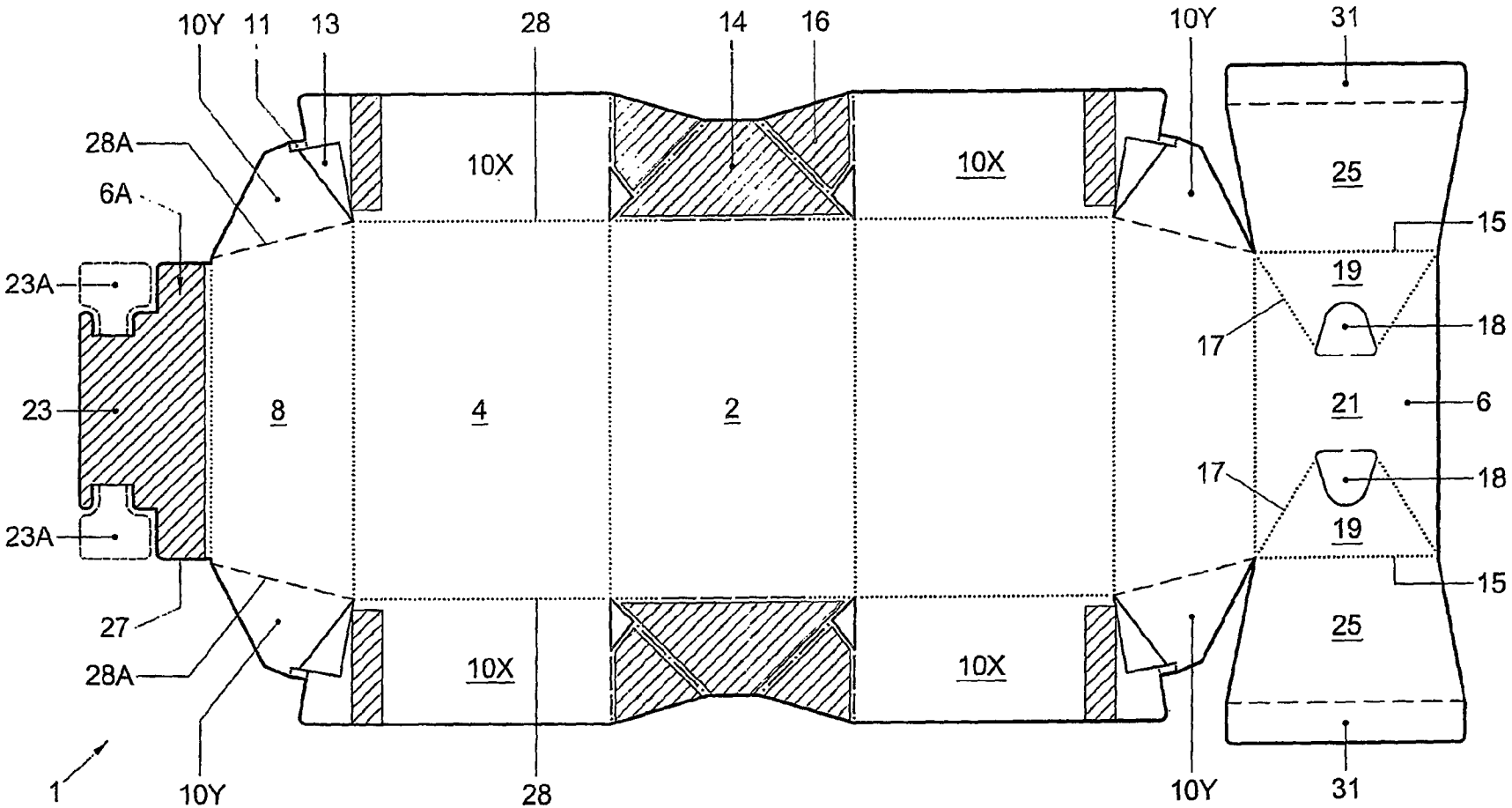

FIG. 8 schematically shows, in side view, a package according to the invention with bottles drawn therein;

FIG. 9 shows an alternative embodiment of a package, manufactured on an apparatus according to the invention, in partly cross-sectioned top plan view;

FIG. 10 schematically shows, in top plan view, the layout of an apparatus according to the invention, for forming a package according to the invention;

FIG. 11 shows a first alternative embodiment of a blank according to the invention; and FIG. 12 shows a second alternative embodiment of a blank according to the invention.

In this description identical or corresponding parts have identical or corresponding reference numerals.

In this drawing, exemplary embodiments are shown merely by way of illustration. They should not be construed to be limitative in any manner. As exemplary embodiments, packages are shown, folded from cardboard, and a blank thereto for packaging six containers, in particular beverage bottles, such as beer bottles, particularly suitable for plastic or glass bottles with a content of, for instance, between 0.2 and 0.75 to 1 liter. However, such a package can naturally be adapted to any desired number of containers, as well as to any liquid measure. To that end, only the dimensions of the blank have to be adjusted. Also, a blank, at least package according to the invention can be used for different containers such as food tins, cans, plastic bottles and the like.

Figure 1:
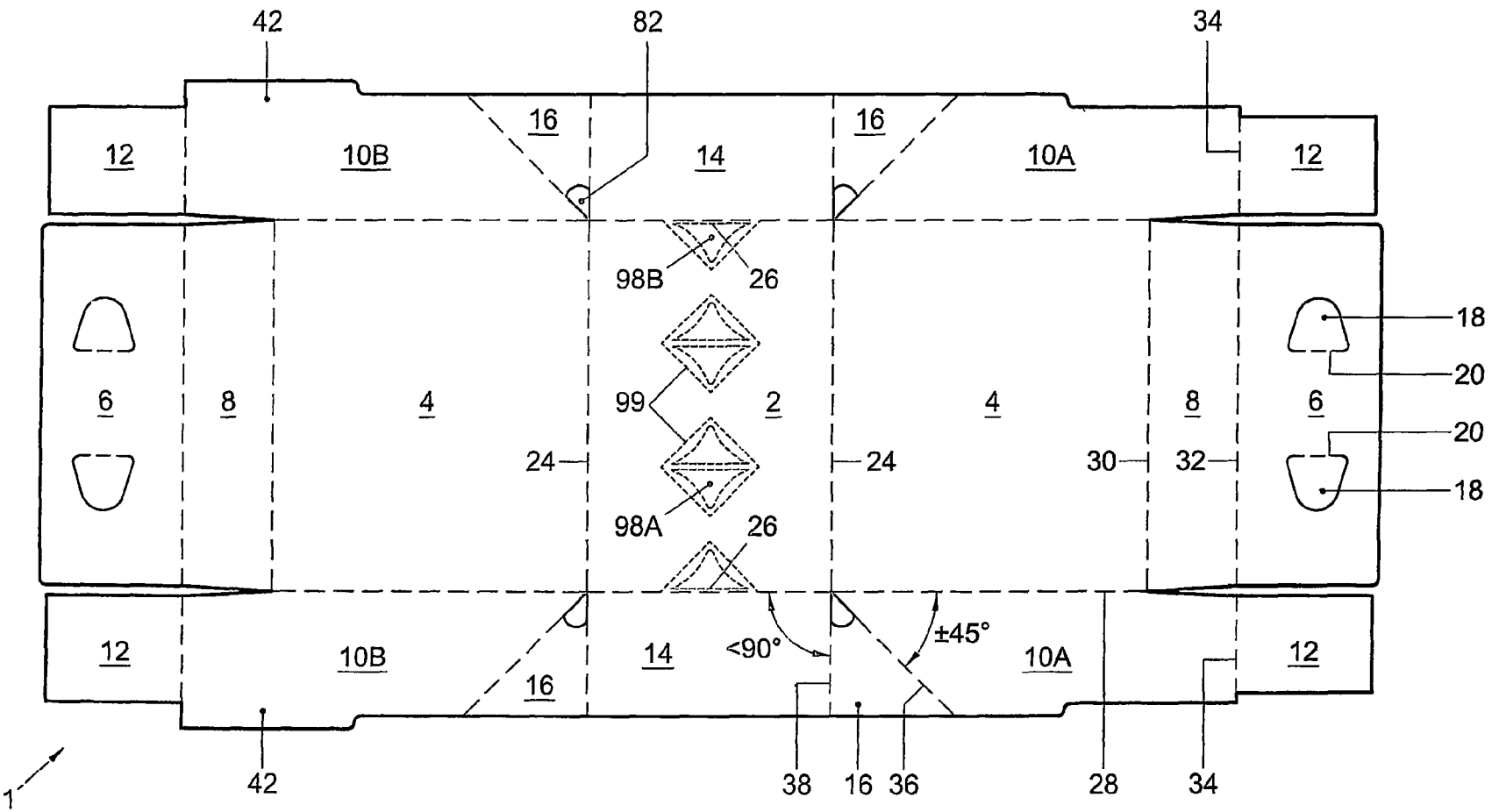
FIG. 1 shows, in folded out condition a blank according to the invention.

In FIG. 1, a blank 1 according to the invention is shown, provided with a substantially closed bottom panel 2, two side panels 4 provided on opposite sides of the bottom, to upper flaps 6 extending away from the side panels 4, connected to the side panels 4 by intermediate flaps 8. On both sides of the side panels 4, end wall flaps 10 are provided, each provided with a top flap 12. In the exemplary embodiment shown, the top flaps 12 extend approximately in line with the end wall flaps 10. On both sides of the bottom panel 2, the end wall flaps 10 are mutually connected by edge flaps 14, connected to the end wall flaps 10 by substantially triangular folding flaps 16. In the upper flaps 6, somewhat triangular folding lips 18 are provided, which can be pressed away along a fold line 20 for reasons to be explained further.

The bottom panel 2 is connected to the side panels 4 by substantially parallel first fold lines 24, and to the edge flaps 14 by substantially parallel second fold lines 26. Via third fold lines 28, extending approximately parallel to each other, the side panels 4 are connected to the end wall flaps 10. On the one side, via fourth fold lines 30 extending approximately parallel to the first fold lines, the intermediate flaps 8 are connected to the side panels and, on the other side, via fifth fold lines 32 extending approximately parallel to the fourth fold lines 30, to the upper flaps 6. Via sixth fold lines 34 extending substantially in line with the fifth fold lines, the top flaps 12 are connected to the end wall flaps 10. The folding flaps 16 are connected, on the one side, to the end wall flaps 10 via seventh fold lines 36 extending at an angle of approximately 45° relative to the third fold lines which extend in line with the second fold lines 26, and, on the other side, via eighth fold lines 38 to the edge flaps 14. The eighth fold line 38 includes an angle with the second fold lines 26 which is smaller than 90°, for instance 85°.

In FIGS. 2-7, in six steps, it is represented how a package according to the invention can be folded from a blank according to FIG. 1, as schematically represented in FIG. 8 in side view.

Figure 2:
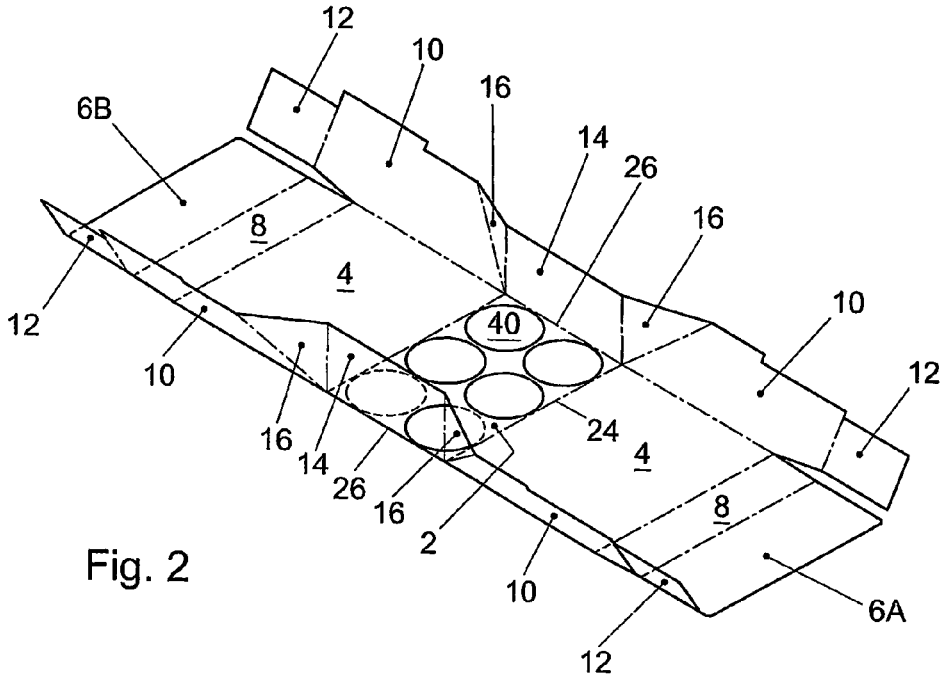
FIGS. 2-7 show, in six steps, setting up a package according to the invention from a blank according to FIG. 1.

Six containers are arranged on the bottom panel 2, the dimensions being selected such that the containers 40 stand approximately against each other and against the respective first and second fold lines 24, 26. In FIG. 2, the bottom panels of the containers 40 are represented as circles.

From the planar condition, the edge flaps 14 are folded upwards against the containers along the second fold lines 26, while the edge flaps include an approximately right-angled angle with the bottom panel 2. The folding flaps 16 and the end wall flaps 10 will then be slightly taken along upwards.

Figure 3:
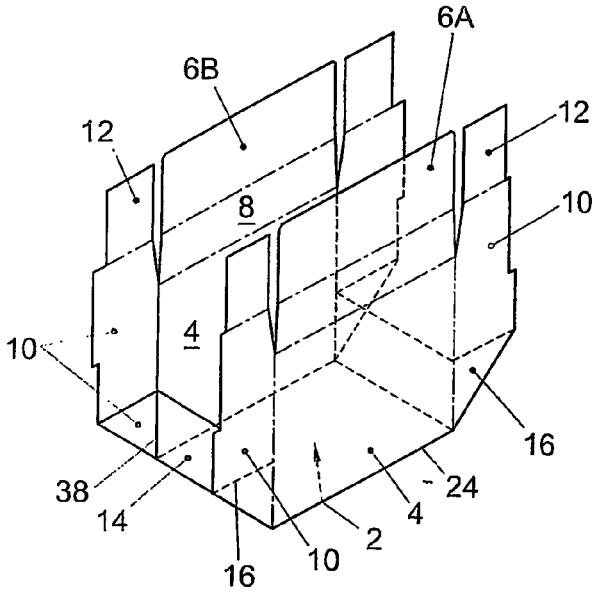

In a second step, shown in FIG. 3, the side panels 4 are also moved upwards, pivoted along the first fold lines 24, against the containers 40 (not shown in FIGS. 3-7) such that the side panels 4 also include an approximately right-angled angle with the bottom 2. The end wall flaps 10 then extend approximately in line with the side panels 4, while the folding flaps 16 are pressed against the inside of the end wall flaps 10. As a result of the angle of less than 90° included between the second fold line 26 and eighth fold line 38, the edge flap 14 is pressed against the containers.

Figure 4:
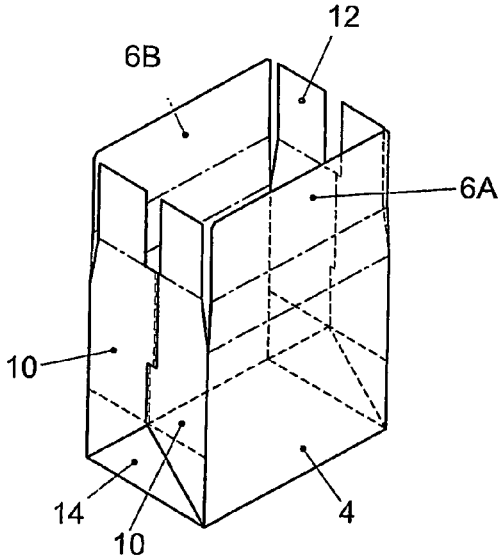

In a third step, the end wall flaps 10 are folded inwards against the containers 40, to the position shown in FIG. 4. In this position, the end wall flaps 10A located at the right-hand side in FIG. 1, will first be folded inwards and then the end wall flaps 10B located on the left hand side. In the embodiment shown, the second end flaps 10B are provided with partial widenings 42, which, in the condition shown in FIG. 4, are folded against the other end wall flaps 10A. Thus, a good closing is obtained. If desired, the widening 42 could be glued or otherwise fastened to the other end wall flap 10A. However, this is not required.

Figure 5:
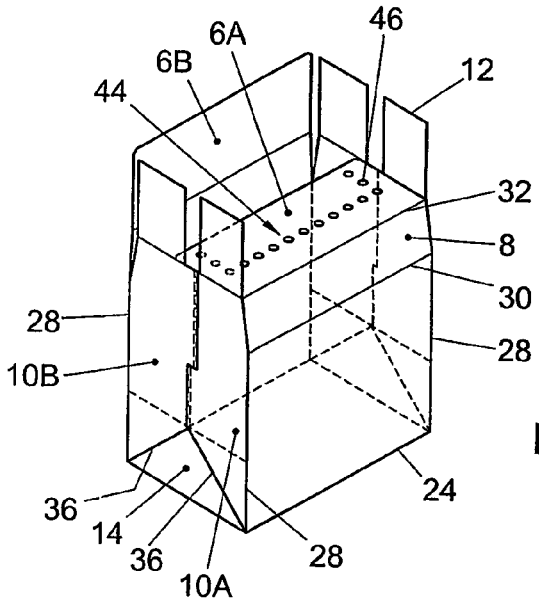

From the position shown in FIG. 4, in a fourth step, as shown in FIG. 5, one of the upper flaps 6, in the exemplary embodiment shown the right hand upper flap 6A, is folded inwards along the fifth fold line 32, while, moreover, the intermediate flap 8 is somewhat taken along, pivoted along the fourth fold line 30. The upper flap 6A is folded on top of the containers, approximately parallel to the bottom panel 2.

Figure 6:
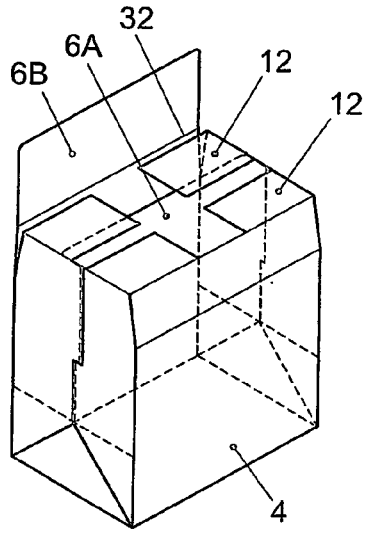

Thereupon, in a fifth step, as shown in FIG. 6, each top flap 12 is pivoted about the respective sixth fold line 34, against the top flap 6A and/or the upper side of the containers 40. Optionally, prior to this folding movement, on the upper side of the top flap 6A, a glue trace can be provided, in the form of a continuous glue trace 44 or in the form of drops, for instance in substantially U-shaped form, as represented in FIG. 5 in the form of glue drops 46, such that when the top flaps 12 are pressed down, they are glued to the upper flap 6A. Such a glue trace 44 can also be provided in the following, sixth step.

Figure 7:
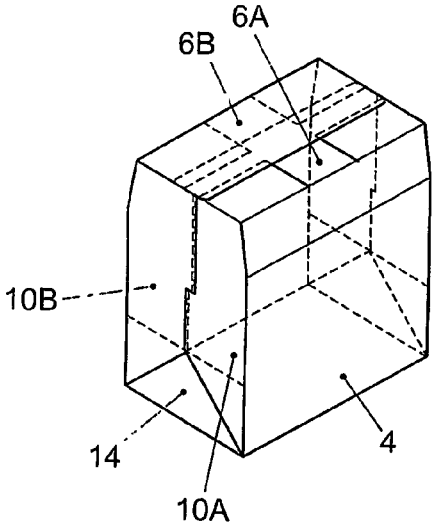

In FIG. 6, the top flaps 12 are folded onto the upper flap 6A and optionally fastened, so that a substantially closed container is obtained. In the following step, only the other top flap 6B is to be folded along the respective fifth fold line 32, on the top flaps 12 and the other upper flap 6A, while being glued by the glue trace 44. The eventual condition is represented in FIG. 7. In this condition, a strong, relatively light package is obtained which can be formed from relatively thin cardboard and which is substantially light-proof. In contrast with, for instance, known comparable types of packages wherein, however, use is made of hooking means in the bottom, as described in the introduction, much material can be economised on, for instance 20 to 40% of cardboard. Furthermore, a package 100 according to the invention can be set up in a simpler manner because the containers can be placed directly on the bottom panel 2 and the further package can simply be folded therearound. The containers can then simply be used as counter means during pressing-on and gluing of the different parts.

With a package according to the invention, the containers are confined well, while the edge flaps 14 and end wall flaps 10 simply secure the containers against sliding and moreover, optionally, can function as cover for, for instance, barcodes on the containers. In this manner, individual containers are prevented from being scanned. A further advantage thereof is that an even better protection of the containers is obtained as a result of several layers of cardboard next to each other. The closed bottom panel 2 yields a better bearing capacity than bottom panels provided with hooking means.

In the embodiment described in FIGS. 2-7, the upper flaps 6A, B and/or the top flaps 12 are mutually glued together for closing the package 100. However, also the folding lips 18, which end up one on top of the other when the package 100 is closed, can be urged inward together, pivoted about the fold lines 20, thereby obtaining a mechanical closing, in particular then, when the folding lips 18 in the upper flap 6B to be closed last are somewhat wider than the folding lips 18 in the other upper flap 6A. Also, both closing means can be used. Moreover, in a simple manner, the folding lips 18 offer a grip for lifting the package 100. The fact is that two fingers can simply be inserted into the openings formed when folding away the folding lips 18 for engagement of the package 100.

It will be clear that the order of folding of, in particular, the two upper flaps 6A, 6B and the top flaps 12 can be chosen to be different. For instance, first, each of the top flaps 12 can be pivoted inwards on top of the containers and only thereupon the upper flaps 6 can be folded one over the other and fastened onto each other. Also, optionally, the top flaps 12 could be folded and fastened last. However, the embodiment shown offers a simple, elegant closing. Many variations of folding are possible, which will be directly clear to the skilled person.

In FIG. 9, an alternative folding manner for a blank according to the invention is shown, which can be carried out, if desired, with a similar folding apparatus. In this embodiment, the end wall flaps 10 are folded inwards against the inside of the side panels 4, so that relatively open ends 48 are obtained. The fact is that then, only the edge flaps 14 are raised. Preferably, they cover barcodes on the containers for reasons mentioned hereinabove.

In FIG. 10, schematically, in top plan view, an apparatus is shown for setting up a package 100 from a blank 1 according to the invention. In this apparatus, a blank 1 in FIG. 10 is fed through from left tot right, after six containers 40 have been arranged on the bottom panel 2 of the blank. The different means for folding the different flaps are only schematically represented. Such means such as cams, wheels, folding guides and the like are known per se from the box making industry and will be directly clear to and applicable by any skilled person. Of importance, in particular, is the order of the different means. In FIG. 10, the steps I-VI are schematically represented and indicated with I-VI. After each of step I-VI, a following phase of setting up is achieved, corresponding with FIGS. 2-7.

In step I, with two pivot cams or wheels 50, each pivotable around first pivots 52 extending substantially horizontally, each of the edge flaps 14 is moved upwards. To that end, from the plane of the drawing, the pivot cams 50 pivot upwards and towards each other. Then, in the second step II, by two curved folding guide paths 54, each of the side panels 4 is moved upwards from the plane of the drawing to a substantially vertical position against the containers 40. In the third step III, with four pivot cams, wheels or the like, represented in FIG. 10 as pivot cams 56, each of the end wall flaps 10 are folded inwards against the container. To that end, the cams 56 are pivotable about two pivots 58, in the direction indicated by the arrows $P_1$.

Thereupon, in the fourth step IV, by a further pivot cam 60, pivotable about a third pivot 62 which extends approximately parallel to the feed-through direction T and approximately horizontally, slightly above the fifth fold line 32, the first upper flap 6A is folded inwards on top of the containers. To that end, the cam 60 pivots in the direction of the arrow $P_2$. Then, with the aid of glue supply means 64, glue is applied to the upper flap 6A in a desired pattern.

Thereupon, in the fifth step V, four tilting cams 66, pivotable about fourth pivots 68 which extend approximately horizontally and at right angles to the transport direction T, the top flaps 12 are pivoted inwards onto the containers and/or the upper flap 6A. To that end, the cams 66 pivot in the direction of the arrows $P_3$.

Thereupon, in the final step VI, a pivot cam 70, pivotable about a fifth pivot 72 in the direction of the arrow $P_4$, pivots the second upper flap 6B inwards onto the first upper flap 6A and/or the top flaps 12. To that end, the fifth pivot 72 extends horizontally, approximately parallel to the transport direction T.

After step VI, the package 100 is ready and can be taken out.

An apparatus 80 according to the invention can be carried out and adjusted particularly simply and can be built up by all sorts of simple, existing cams. With such an apparatus, a package as shown in FIGS. 7 and 8 as well as a package of FIG. 9 can be formed, while only the order is to be slightly adapted in a logical manner. A further advantage of an apparatus 80 according to the invention, as schematically shown in FIG. 10, is that it can particularly simply be adapted to other sizes of blanks 1, for instance for a different number of containers and/or for containers of different sizes or different types. The fact is that to this end, only the different cams and guiding paths are to be slid closer together or, conversely, further apart which can be done in a simple manner.

In the corners of the folding flaps 16, adjacent the bottom panels 2, openings 82 provided so that folding the package is possible in easier manner. The fact is that as a result thereof less material is obtained in the corner between the folding flaps, edge flaps and end wall flaps 16, 14, 10.

In FIG. 11, an alternative embodiment of a blank 1 according to the invention is shown, wherein parts corresponding with the part of a blank according to FIG. 1 are numbered in the same manner. The same holds for the alternative embodiment according to FIG. 12. For the description of those parts reference is made to the description of claim 1.

In a blank 1 according to FIG. 11, the edge flaps 14, which are connected to the bottom panel 2, are substantially triangular while the substantially triangular folding flaps 16 are located on both sides of said edge flaps 14, between the eighth fold lines 38, which are approximately in line with the first fold lines 24. Therefore, when setting up a package 100 from a blank 1 according to FIG. 11, the folding flaps 16 will be confined between the edge flaps 14 and the end wall flaps 10A, 10B, respectively, while the eighth fold lines 38 will be approximately parallel to the bottom panel 2, so that entirely closed end walls of the package 100 are obtained. These offer a large surface that can be printed.

With this blank 1, two upper flaps 6, 6 A are provided, each with a substantially rectangular form. On the blank 1 it is indicated with the aid of hatchings where the blank can be glued when setting it up. Therefore, the flaps 12 are glued under the upper flap 6A, shown on the right-hand side in FIG. 11 or glued thereon, the other upper flap 6 is glued onto upper flap 6A. Both upper flaps are provided with openings 18, while, with the package 100 in set-up condition, in the uppermost flap 6, lips are provided in the openings, which can be folded through the openings in the underlying flap 6A when lifting the package 100. In at least the outside upper flap 6, from each fold line 20 towards the adjacent longitudinal edge of the respective flap 6, two diverging tear lines 17 are provided between which a tear tab 19 is enclosed. Preferably, comparable tear lines 17A are provided in the other upper flap 6A, which tear lines 17, 17A, with the package set-up, are located one above the other. As a result, the tear tabs 19 can simply be torn away, so that the package can be opened. In an advantageous embodiment, the third fold lines 28 can be designed, for instance, as relatively simple tear lines, for instance perforation lines, so that an entire end wall (tear tab 19 with contiguous end wall flaps 10) can be torn open. The upper flaps 6, 6A overlying each other offer a particularly great firmness and great bearing capacity with relatively thin, light cardboard.

In FIG. 12, a second alternative embodiment of blank 1 according to the invention is shown which, as to bottom panel 2 with edge flaps 14 and folding flaps 16, corresponds with the embodiment of FIG. 11. In this embodiment, the end wall flaps 10 are divided into a substantially rectangular part 10X, contiguous to the side panels 4, while second parts 10Y are connected to the two sides of the intermediate flap 8 via intermediate fold lines 28A. The two end wall flaps 10X, 10Y are mutually connected by a connecting element 11, while between the end wall flaps 10X, 10Y, a recess 13 is provided.

The upper flap 6 shown on the right-hand side in FIG. 12 which, with the package 100 set-up, is located on the outside, is connected on two opposite sides, via a fold line 15 to a shoulder flap 25 with a slightly trapezoid-shaped contour. The opposite second upper flap 6A comprises a relatively narrow strip 27 which is connected via the fold line 32 to the intermediate flap 8 and, on the opposite side, is provided with a bridge part 23 which, with the package 100 set-up, can be glued under the part 21 of the opposite upper flap 6 between the openings 18. When setting up a package 100 from a blank 1 according to FIG. 12, the shoulder flaps 26 are glued onto the end wall flaps 10Y, while glue flaps 31, connected to the shoulder flaps 25 are glued on the parts of the other end flaps 10X indicated in hatchings. The bridge part 23 effects a great bearing strength. Here, also, tear lines 17 are provided for forming tear tabs 19, which are directly connected to the shoulder flaps 25. When opening a package 100, set up from a blank 1 according to FIG. 12, therefore, a large part of a side panel is opened in one go by tearing away the tear tab with the respective shoulder flap 25.

In FIG. 12, schematically, in interrupted lines, on both sides of the top flap, a sub-top flap 23A is provided, as additional option. These sub-top flaps 23A can be folded under the top flap 23 for further increase of the bearing capacity.

Herein, what is meant by a substantially closed bottom is at least understood to include a bottom without hooking means or edges reaching one over the other for closure thereof and should not only include a fully closed bottom but also a bottom with some recesses, for instance a recess for allowing the passage of pillars from a pillar crate.

For instance, in FIG. 1 and FIG. 9, in interrupted lines, three openings 99 are represented for allowing the passage of pillars. In this embodiment, middle pillars 98A are shown with a substantially square cross section with hollow sides, adapted to the containers, in particular bottles that are to be received in the package. The outer pillars 98B can have a substantially triangular shape, half of a middle pillar. As a result, the different sizes multi-packs can be included in such a pillar crate, in particular if all pillars of such a crate are designed as the pillars 98B, or a middle pillar 99A with a vertical slit in which two end walls 48 fit next to each other. The invention comprises such a crate.

The invention is not limited in any manner to the exemplary embodiments represented in the description and the drawing. Many variations thereon are possible within the framework of the invention, among which all combinations of parts of the embodiments shown.

For instance, the different flaps can have different forms and dimensions, the end flaps for instance can have a smaller width so that they do not overlap or, conversely, have a greater width so that they overlap virtually completely. The same holds for the upper flaps. The fact is that, each time, they can be fastened to the top flaps. Optionally, the intermediate flaps 8 can be omitted, while furthermore, further flaps can be provided, for instance for compartmenting the package. Instead of glue, other means can be used, for instance staples, form-closing means and the like. These and many comparable variations are understood to fall within the framework of the invention as outlined by the claims.

The invention claimed is:

1. A package for containers folded from a blank, provided with:

a substantially closed bottom panel;

two side panels, upstanding from the bottom panel, on opposite sides thereof;

two upper flaps, each extending from an opposite one of the side panels, folded in an inward direction from the side panels to at least partially overlap each other over containers arranged on the bottom panel and collectively form an upper panel;

end wall flaps extending on both sides of each side panel while confining the containers; and top flaps extending from the upper edges of the end wall flaps facing away from the bottom panel, below or between the upper flaps;

wherein at least two of the top flaps and/or the upper flaps are attached to each other.

2. A package according to claim 1, wherein the end wall flaps are mutually connected on both ends of the bottom panel by edge flaps extending from the bottom panel.

3. A package according to claim 2, wherein the edge flaps are connected to the end wall flaps by folding flaps, such that the package can be folded from a planar blank.

4. A package according to claim 1, wherein the end wall flaps overlap, at least partly.

5. A package according to claim 1, wherein a first upper flap rests on the top side of the containers, while on the upper side of the first upper flap at least one glue trace is provided which extends along at least one edge of said first upper flap, the top flaps and a second upper flap being fastened to the first upper flap with the aid of said at least one glue trace.

6. A package according to claim 5, wherein said at least one glue trace is built up from individual glue surfaces.

7. A package according to claim 1, wherein, in both upper flaps, recesses are provided overlapping each other at least partly, while in the recesses in the overlying upper flap folding lips are provided which are or can be pressed through the underlying recesses, such that said folding lips connect the two upper flaps and engagement openings are provided for lifting the package.

8. A package according to claim 5, wherein said at least one glue trace extends along at least three edges of said first upper flap.

9. A package according to claim 6, wherein said individual glue surfaces are drops.

10. A package according to claim 1, further comprising containers disposed within the package, wherein the containers are bottles or cans.

11. A blank for a package for containers, provided with:

a substantially closed bottom panel;

two side panels connected to the bottom panel via first fold lines extending parallel to each other;

first and second upper flaps each connected to an opposite one of the side panels via fifth fold lines extending substantially parallel to the first fold lines to be folded in inward directions about the fifth fold lines to collectively form an upper panel, wherein the first and second upper flaps include dimensions suitable to allow the first and second upper flaps to at least partially overlap each other over a region of the bottom panel that is to support the containers when placed within the package;

end wall flaps connected to the side panels via third fold lines extending substantially at right angles to the first and fifth fold lines; and top flaps connected to the end wall flaps via sixth fold lines extending approximately in line with, at least substantially parallel to the fifth fold lines.

12. A blank according to claim 11, further provided with edge flaps connected to the bottom panel via second fold lines extending approximately in line with, at least parallel to the third fold lines.

13. A blank according to claim 12, wherein each edge flap, via an eighth fold line, is connected to a substantially triangular folding flap, which folding flap is connected to an end wall flap via a seventh fold line.

14. A blank according to claim 11, wherein the bottom panel has a width viewed in the longitudinal direction of the second fold lines and a length viewed in the longitudinal direction of the first and fifth fold lines, while the joint length of the end wall flaps, measured approximately at right angles to the third fold lines, is approximately equal to or slightly greater than the width of the bottom panel.

15. A blank according to claim 11, wherein the side panels have a height, measured between the respective first and fifth fold lines, while the end wall flaps have a height which is substantially equal to the height of said side panels.

16. A blank according to claim 11, wherein the top flaps have a length, measured approximately at right angles to the sixth fold lines, which is approximately equal to or slightly smaller than the length of the upper flaps, measured approximately at right angles to the fifth fold lines.

17. A blank according to claim 11, wherein the upper flaps have a length such that, with the package set up, they overlap while in each of the upper flaps at least two recesses are provided, while in the recesses of at least one upper flap folding lips are provided, connected to the respective upper flap via a fold line, which folding lips widen somewhat from said fold line, while the greatest width of the folding lips is greater than the greatest width of the recesses in the other upper flap, measured approximately parallel to said fold line.

18. A package comprising a blank according to claim 8, wherein on the bottom panel at least one row of containers is arranged, which containers are arranged against each other and extend along the longitudinal edges of the bottom panel, said blank having been arranged as follows:

the side panels folded on opposite sides against the containers;

the end wall flaps folded on opposite ends against the containers;

the first upper flap, the top flaps and the second upper flap folded over the top side of the containers;

the top flaps received between the containers and the first upper flap and/or between the first and/or the second upper flap; and wherein the first and second upper flap are connected to each other and/or to the top flaps.

19. A package comprising a blank according to claim 12, wherein on the bottom panel at least one row of containers is arranged, which containers are arranged against each other and extend along the longitudinal edges of the bottom panel, said blank having been arranged as follows:

the side panels folded on opposite sides against the containers;

the edge flaps folded on opposite ends against the containers;

the end wall flaps folded on opposite ends against the containers and/or the edge flaps;

the first upper flap, the top flaps and the second upper flap folded over the top side of the containers;

the top flaps received between the containers and the first upper flap and/or between the first and/or second upper flap; and wherein the first and second upper flap are connected to each other and/or the top flaps.

20. A package for containers folded from a blank, the package comprising:

a substantially closed bottom panel;

two side panels, upstanding from the bottom panel, on opposite sides thereof;

two upper flaps, each extending from an opposite one of the side panels and folded in an inward direction from the side panels to at least partially overlap each other over containers arranged on the bottom panel;

an aperture formed in each of the two upper flaps, wherein the aperture provided to one of the two upper flaps is aligned with the aperture provided to another of the two upper flaps to define a carry opening that extends through both of the two upper flaps and leads into an interior of the package;

end wall flaps extending on both sides of each side panel while confining the containers; and top flaps extending from the upper edges of the end wall flaps facing away from the bottom panel, below or between the upper flaps;

wherein at least the top flaps and/or the upper flaps are attached to each other.

21. A blank for a package for containers, provided with:

a substantially closed bottom panel;

two side panels connected to the bottom panel via first fold lines extending parallel to each other;

first and second upper flaps each connected to an opposite side of the side panels via fifth fold lines extending substantially parallel to the first fold lines to be folded in inward directions about the fifth fold lines to collectively form an upper panel above that is substantially parallel with the bottom panel, wherein the first and second upper flaps include dimensions suitable to allow the first and second upper flaps to at least partially overlap each other over a region of the bottom panel that is to support the containers when placed within the package;

an aperture formed in each of the first and second upper flaps, wherein the aperture provided to the first upper flap is aligned with the aperture provided to the second upper flap when the first and second upper flaps are folded about the fifth fold lines in the inward directions to define a carry opening that extends through both of the first and second upper flaps and leads into an interior of the package;

end wall flaps connected to the side panels via third fold lines extending substantially at right angles to the first and fifth fold lines; and top flaps connected to the end wall flaps via sixth fold lines extending approximately in line with, at least substantially parallel to the fifth fold lines.

* * * * *

UNITED STATES PATENT AND TRADEMARK OFFICE

CERTIFICATE OF CORRECTION

PATENT NO. : 7,731,027 B2
APPLICATION NO. : 10/551744
DATED : June 8, 2010
INVENTOR(S) : Jan Peter Kruit It is certified that error appears in the above-identified patent and that said Letters Patent is hereby corrected as shown below:

In column 11, line 12, in Claim 18, please delete "claim 8", and insert therefor --claim 11--.

Signed and Sealed this

Twenty-eighth Day of September, 2010

David J. Kappos

David J. Kappos
*Director of the United States Patent and Trademark Office*